US005170691A

United States Patent [19]

Baatrup

[11] Patent Number: 5,170,691

[45] Date of Patent: Dec. 15, 1992

[54] FLUID PRESSURE AMPLIFIER

[76] Inventor: Johannes V. Baatrup, Henrik Ibsensvej 7, DK-6400 Sonderborg, Denmark

[21] Appl. No.: 567,784

[22] Filed: Aug. 15, 1990

[51] Int. Cl.[5] ..... F01L 25/02

[52] U.S. Cl. ..... 91/287; 91/290; 91/319; 91/321; 417/403

[58] Field of Search ..... 60/563, 593; 91/287, 91/290, 319, 321, 417; 417/325, 403; 137/596.18

[56] References Cited

U.S. PATENT DOCUMENTS

| | | | |
|---|---|---|---|
| 2,583,285 | 1/1952 | Zehnder | 91/290 |
| 2,722,233 | 11/1955 | Schneck | 137/596.18 |
| 2,722,946 | 11/1955 | Mueller | 137/596.18 |
| 3,863,672 | 2/1975 | Theriot et al. | 137/596.18 |
| 4,509,330 | 4/1985 | Zimber et al. | 60/563 |
| 4,864,914 | 9/1989 | LeMoine | 60/563 |

FOREIGN PATENT DOCUMENTS

| | | | |
|---|---|---|---|
| 1276629 | 6/1972 | United Kingdom | 417/403 |

*Primary Examiner*—Edward K. Look
*Assistant Examiner*—Hoang Nguyen
*Attorney, Agent, or Firm*—Antonelli, Terry, Stout & Kraus

[57] ABSTRACT

A continually operating fluid pressure amplifier having a reciprocating piston system comprising a broad low pressure piston and a narrow high pressure piston, of which the latter, together with its piston cylinder, is arranged as a three-way pilot valve for operating a bistable control valve that controls the reciprocation of the piston system. The control valve has a primary valve slide controlling the said reciprocation and an auxiliary slide operable to open and close relevant conduit connections for initial amplification of the shift control signals governing the operation of the control valve, whereby a very safe operation of the entire system is ensured. Also ensured is a rapid return stroking of the piston system, such that the produced high pressure can be maintained substantially constant.

1 Claim, 3 Drawing Sheets

FLUID PRESSURE AMPLIFIER

FIELD OF THE INVENTION

The present invention relates to a pressure amplifier of the type comprising a reciprocating piston system having a broad piston working in a low pressure cylinder and a narrow piston working in a narrow cylinder, whereby the introduction of a relatively low pressurized fluid into the former cylinder will result in a displacement of the narrow piston in the latter cylinder, such that a fluid in this cylinder can be discharged with an increased pressure, though at a decreased rate of flow compared with the flow introduced into the low pressure cylinder.

BACKGROUND OF THE INVENTION

Pressure amplifiers of this type are relatively simple compared with devices for raising the pressure directly from zero to the required high value, but for many applications it is a disturbing fact that the oscillating motion of the amplifier piston system gives rise to fluctuations of the high pressure as delivered from the amplifier. Of course, the high pressure fluid is delivered through a check valve which will prevent backflow to the low or medium pressure system, but if there is a certain fluid consumption or leakage in the high pressure system a pressure drop may well occur therein if the high pressurized fluid is not fully constantly supplied from the pressure amplifier. Since the amplification is a matter of reciprocating a piston system it will be unavoidable that such pressure drops may occur, already because the piston system has to stop its action whenever its direction of movement is being inverted.

There is distinguished between single-acting and double-acting pressure amplifiers, just as with piston pumps, and obviously a double-acting device will be better suited to produce an almost constant discharge pressure, because in a double-acting system there is no operational pause connected with an idle return stroke of the piston system as in a single-acting system. However, there may still be problems with respect to a rapid and safe actuation of the means for cylically changing the direction of movement of the piston system. For many applications it is a major demand that the pressure amplifier should be of a small size and of a low price, and for that reason the single-acting devices are preferred for many purposes, e.g. for incorporation in various types of tools and vehicles. When used e.g. in connection with hydraulic actuators for the holding of workpieces being worked the pressure amplifiers should be able to maintain the discharge pressure almost constant.

Still, however, the single-acting amplifiers show the drawback of a relatively low effective working frequency due to the need of an idle return stroke for each working stroke. This implies relatively large outer dimensions for a given rate of high pressure flow, and pressure dives are liable to occur at the high pressure side.

The U.S. Pat. No. 3,737,254 discloses such an amplifier and asserts that the return switching is effected instantaneously, but since during the switching phase the axial forces acting upon the switch controlling mechanism are directed opposite the moving direction of the piston system, and since the fluid from the low pressure cylinder chambers has to pass through relatively long and narrow channels, the resulting working frequency is bound to be relatively low anyway.

For simplicity the piston system should be reciprocated by the medium pressure fluid, i.e. by the fluid moving the system through both its working strokes and its return strokes, and also the associated switch control should be effected by the medium pressure fluid. This invites to the use of a simple slide controller, which is reversed, directly or indirectly, in response to the piston system arriving at its respective extreme positions, so as to thereby be operated to connect the relevant piston chambers with the medium pressure source and a low pressure return system in an alternating manner. However, such simple control systems are well known to present some important operational problems, inter alia because, for a really safe switching operation, they have to be provided with some narrow channels, so-called nozzles, whereby the system is vulnerable to a dirt blocking and is rather slow in its reactions. Moreover the nozzles are subjected to wear, whereby after some time the system may become unstable. These problems could be reduced with the use of thicker valve channels, but that would give rise to problems with respect to the safety of the switching operations and partly unexplainable situations of equilibrium may occur, where the reciprocating piston system just stops working.

It is known to stabilize the operation based on a mechanical snap locking of the slide controller in its respective extreme positions, but this implies increased costs and space requirements, and moreover the locking system will be subjected to wear.

SUMMARY OF THE INVENTION

It is the primary purpose of this invention to provide a system of the type referred to, which, with a simple modification, can be made to operate in a reliable manner, with rapid control switch functions and rapid return strokes of the piston system, and yet without any need of using mechanical snap lock means or narrow nozzle passages in the control system.

According to the invention use is still made of the slide controller, which has a first valve part member with bores connected with the medium pressure source and the cylinder chambers of the respective opposite sides of the said low pressure piston, respectively, and a second valve part reciprocally slidably arranged relative to the first valve part and urged by spring means towards a first end position, in which it establishes a free flow connections between the connections to the cylinder chambers and a blocking of fluid inlet from the medium pressure source, with the second valve part being urgable by the medium pressure to an opposite, second end position, in which it establishes a connection between the inlet of medium pressure fluid and the cylinder chamber responsible for the working stroke of the piston system, while blocking for the outlet from the opposite cylinder chamber. The latter is permanently connected also to the low pressure return system, such that the fluid in that chamber can easily escape therefrom during the working stroke.

Further according to the invention the means for supplying the medium pressure to the slide, i.e. the second valve member, are constituted by a pilot connection to the high pressure cylinder portion at such a place thereof which is uncovered by the high pressure piston in both of its extreme positions, but otherwise closed by the piston, whereby after a working stroke this connection will be open to the front side of the high pressure piston and therewith directly to the medium pressure, while at the end of each return stroke this particular connection will be open towards the cylinder chamber portion connected with the low pressure return system.

This will involve that the position of the second valve member will be shifted towards its first end position by the action of the said spring means, for example when the oppositely directed control pressure on the second valve member is relieved at the end of the working stroke of the piston system, while a shifting to the second end position is brought about at the end of each return stroke of the piston system, when the control pressure on the second valve member is increased towards the applied medium pressure, thereby enabling the second valve member to be displaced against the action of the spring means.

Still further according to the invention the second valve member cooperates with an auxiliary slide, which moves along with the second valve member except through the respective outermost partial distances, where the auxiliary slide is held back by abutting respective opposed stop portions of the first valve member, such that the mutual positions of the second valve member and the auxiliary slide are shifted at the end of each switching stroke. The auxiliary slide acts as a valve means between the pilot connection and respective outlet and inlet means of the second valve member, all in such a manner that at the end of a return stroke of the piston system a very direct connection will be opened briefly between the medium pressure source and the remote end of the pilot connection, i.e. the end at which the pilot pressure acts upon the control valve system, whereby extra security is obtained for the control valve system to complete its shifting into the position in which it conditions an operational switch over from return stroking to working stroking of the piston system.

Although the last mentioned connection will be closed very soon after the opening thereof, for example, during the very final phase of the movement of the second valve member, it is nevertheless hereby ensured, by the connection initially being fully open, that the valve shifting will take place rapidly and with a high degree of safety.

At an opposite end of the control valve system the auxiliary slide is operable to briefly open a connection between the remote end of the pilot connection and the conduit leading to both the low pressure return system and to the low pressure side of the piston system, before this connection is broken by the very final motion of the second valve member towards its respective end position. Hereby it is achieved that at the end of each working stroke, when the piston system opens the pilot connection to the fluid return system and thus enables the spring means of the slide controller to shift the position of the second valve member, an additional connection will be established directly between the pilot system and the return system, whereby the pilot pressure is extra relievable for a safe and fast return movement of the second valve member. Thus, the return stroke of the piston system can be initiated in a reliable manner immediately at the end of the working stroke.

During the final phase of the shifting the auxiliary slide will get stopped so as to cause the auxiliary connection to be closed. Now it has served its purpose, and it should of course not be open when, during the following sequence, the pilot connection is opened to the medium pressure system. By the same relative movement between the second valve member and the auxiliary slide the connection at the first mentioned end of the latter will be opened, but due to the displaced position of the second valve member relative to the first valve member it will not be made operative until this position is again changed, for example, as described at the end of the return stroke of the piston system. In this manner the internal connection can be opened preparatory to being brought into operation, and there will be no difficulties with respect to the alternating connection of the pilot system with the return system and the medium pressure system, respectively. There will be no possibility of any direct connection between the two latter systems at any time.

BRIEF DESCRIPTION OF THE DRAWINGS

In the following the invention is described in more detail with reference to the drawing, wherein FIG. 1 is a schematic diagram of a pressure amplifier system according to the invention, while

DETAILED DESCRIPTION

Figure 1:
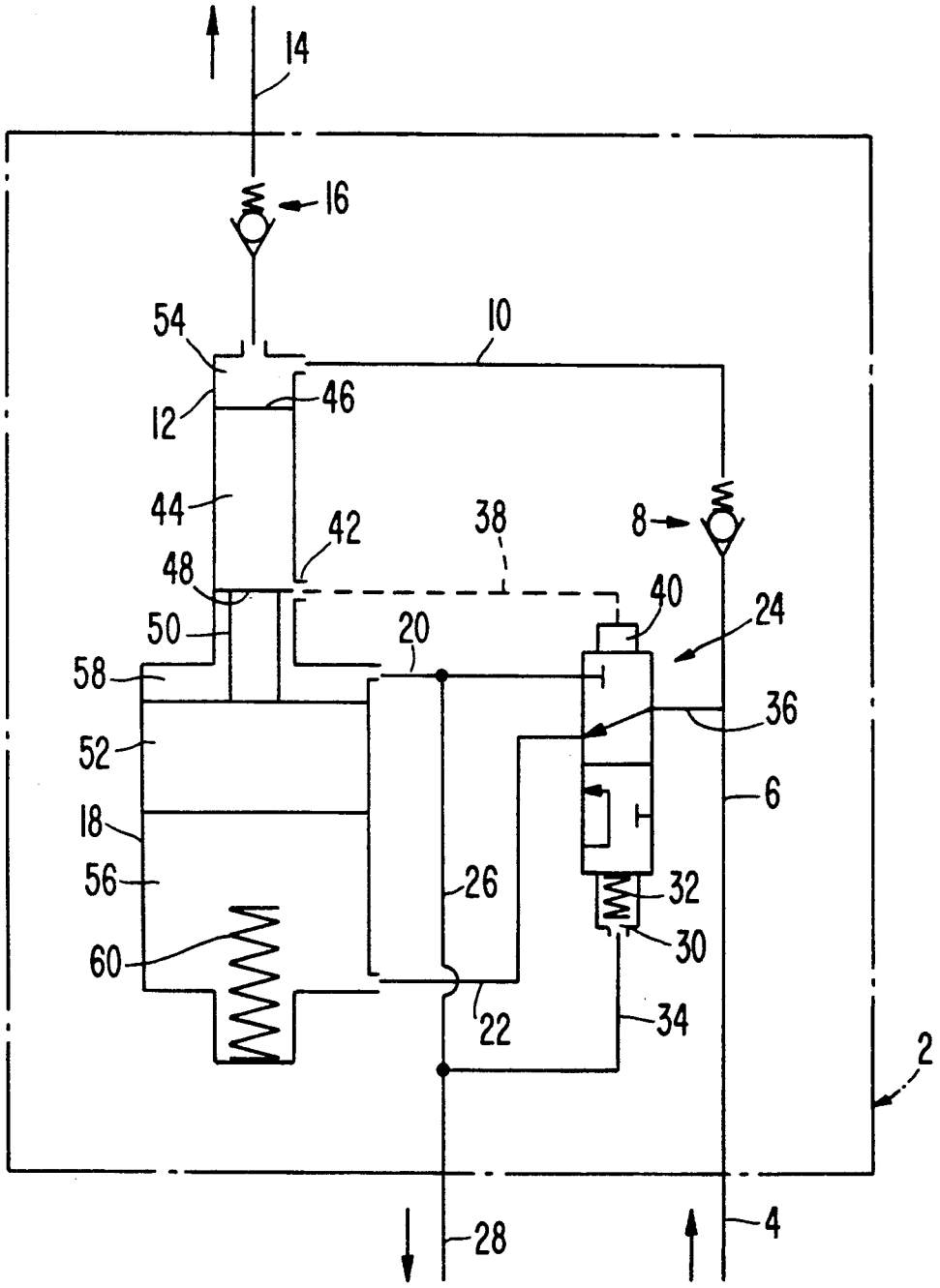

In FIG. 1 is shown a unit 2 having an inlet 4 for a medium pressurized fluid, which is passed through a pipe 6, a check valve 8, and a pipe 10 to the top end of a high pressure cylinder 12, from which there is arranged a high pressure outlet 14 through a check valve 16. The cylinder 12 is mounted at the top of a wider low pressure cylinder 18 being connected at the top and bottom with respective pipes or channels 20 and 22 connected to a shift control unit 24. The pipe 20 has a branch 26 leading directly to an outlet 28 connected with a return tank for the fluid.

The control unit 24 has a lower housing portion 30, which holds a compression spring 32 and is connected, via a pipe 34, to the return pipe 26 and thus to the outlet 28. Also connected to the control unit 24 is a branch 36 from the inlet pipe 6, while a pilot pipe 38 is connected to an upper housing portion 40 of the unit. At its other end the pilot pipe 38 is connected to a stub 42 at the lower end of the high pressure cylinder 12.

The upper cylinder 12 has a piston 44 with upper end 46 and, lower end 48, and through a connector rod or rather spacer rod 50 this piston is in connection with a wider piston 52 in the lower cylinder 18. The cylinder chamber above the piston 44 is designated 54, while the chamber underneath the lower piston is designated 56 and the chamber between the two pistons 58. A compression spring 60 is mounted upstanding from the bottom of the lower cylinder chamber 56 so as to be engageable by the lower side of the piston 52. Alternatively this spring could be mounted depending from the piston.

Controlled by the pressure in the pilot pipe 38, the control unit 24 is shiftable between two connection modes as depicted graphically, for example, one in which there is a direct connection between the pipes 20 and 22, while the inlet branch 36 is blocked, and one in which the inlet branch 36 is connected to the pipe or channel 22.

Briefly, the system shown will operate in the following manner:

Fluid under medium pressure from the inlet 4 is introduced through the parts 6, 8 and 10 into the upper cylinder chamber 54, whereby the piston system 44,50,52 is forced downwardly. Governed by the spring 32 the control unit 24 provides for a "return condition" as shown in the upper half of the unit graph, i.e. in which the fluid can flow freely from the lower cylinder chamber 56 to the intermediate chamber 58, with any surplus fluid escaping to the return tank through the connection 26,28. Thus, the piston system will be moved into a bottom position, in which the top edge 46 of the upper piston 44 will cause the stub 42 to be opened to the upper cylinder space 54. By this connection the medium pressure in that chamber will gain access to the pilot pipe 38 and thereby cause a shifting of the control unit into its "working stroke" condition, in which it connects the inlet branch 36 to the pipe 22, whereby the medium pressure fluid is supplied to the lower piston chamber 56 while the pipe 20 is connected only to the outlet 26,28. The medium pressure fluid thus acting on the bottom side of the broad piston 52 will force the piston system upwardly, whereby the narrower upper piston 44 produces a substantially higher pressure in the chamber 54 and therewith in the outlet pipe 14; hence the desired pressure amplification. When the piston system is forced upwardly to the point where the lower piston edge 48 registers with the stub 42 the situation will be changed, as the pilot pipe 38 will then be connected to the low pressure chamber 58 between the two pistons. Hereby the control unit 24 is switched back into its "return" mode, governed by the action of the spring 32, whereby the connection between the pipes 20 and 22 will be reestablished and the piston system will be allowed to be forced down by the intermediate pressure acting upon the upper piston surface 46.

In principle the system thus described will work perfectly by reciprocating the piston system so as to maintain a high pressure on the outlet pipe 14, and the system described is rather simple in utilizing the piston 44 directly as a control valve member for changing the control pressure in the pilot line 38 according to the upper or lower positioning of the piston system.

The piston spring 60 is designed such that it will allow the piston system 44,52 to be pressed fully down only when the medium pressure, as introduced through the conduit 10, is sufficiently high to effect compression of the spring 32 in the slide controller 24. Thus, the system will stop whenever the pressure at the inlet 4 is not sufficient to condition a safe operation of the system.

The control unit 24 is shown in more detail in FIGS. 2–5. It comprises a cylindrical outer housing or first slide valve member 64 having an axial bore 66, in which a cylindrical inner slide 68 is arranged, consisting of an outer slide or second valve member 70 and an inner, auxiliary slide 72. The latter is in frictional engagement with inside of the slide 70 by a friction ring 74 mounted adjacent the lower end of the slide 70, this end being closed by means of a stopper 76, which abuts the upper end of the spring 32 in the chamber portion 30.

The outer housing 64 has connector openings for the various conduits 36,20,22,34 and 38. The bottom chamber 30 has an upper shoulder portion 78 forming a stop for downward movement of the slide 70. At its upper end the housing 64 is provided with an internal cylindrical recess 80, which takes up a cross pin 82 mounted through an upper end portion of the interior, tubular slide 72, so as to limit the axial movability of the interior slide 72 to the displacement of the pin 82 between the upper and lower end of the recess 80.

Figure 2:
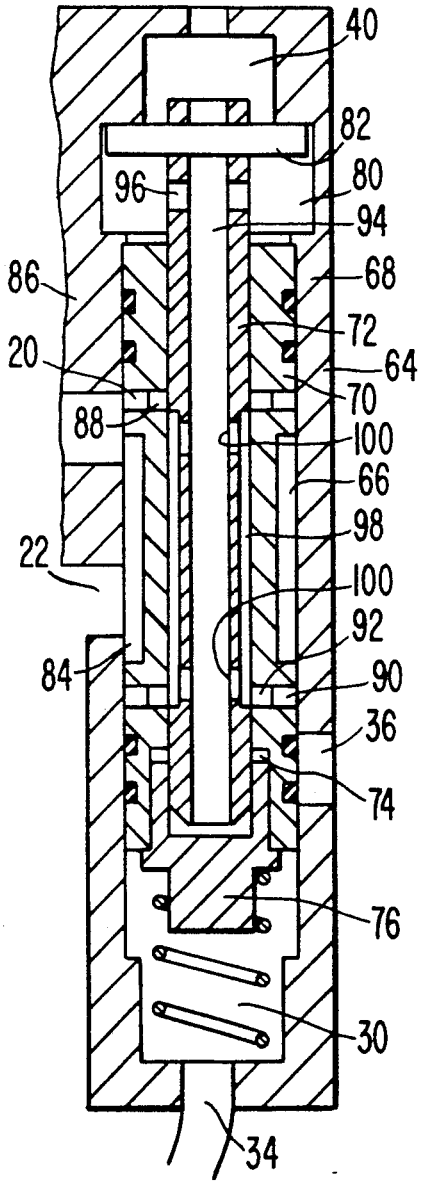
FIGS. 2-5 are sectional views of a control unit therein.
Figure 5:
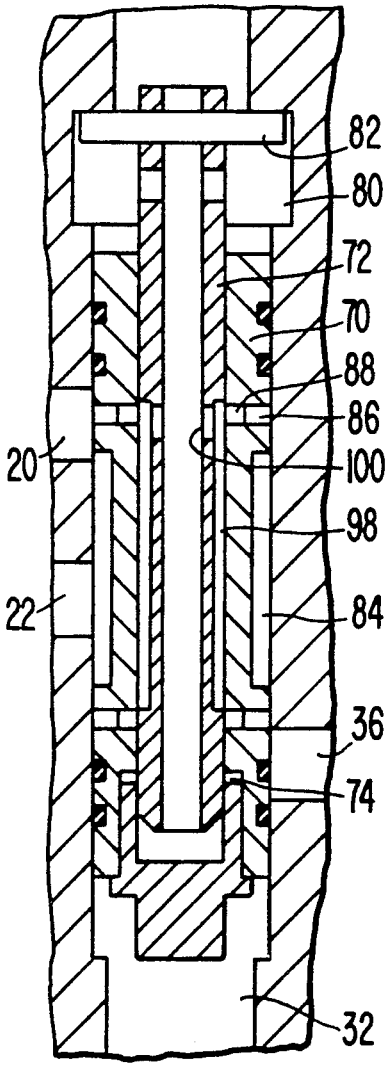

The slide 70 is shaped with an outer cylindrical recess 84, which, as shown in FIGS. 2 and 5, is usable for the interconnection of the two conduits 20 and 22, while just above the upper end of this recess the slide 70 is provided with an outer annular recess 86, which is open towards the inner side of the slide through a number of radial bores 88. A similar recess and bore system 90,92 is provided just below the lower end of the cylindrical recess 84.

The central bore, 94, of the innermost tubular slide 72 is in open connection with the upper chamber portion 40 of the housing 64, directly or through radial holes 96 in the top end of the slide, and the bore 94 is open at the bottom. In the outside of this auxiliary slide member there is provided a cylindrical recess 98, at the top and bottom ends of which there are arranged radial holes 100 connecting the central bore 94 with the said recess 98.

FIG. 2 may represent a start situation, in which the piston system 44,52 assumes an upper position and the slide 68 in the control unit 24 also assumes an upper position, biased by the spring 32, which urges the slide system 70,72 upwardly so as to force the cross pin 82 against the top end of the recess 80 in the upper end of the housing 64. The connector stub 42 and therewith the pilot conduit 38 is connected to the intermediate cylinder chamber 58 and thereby to the return pipe 26, whereby the control slide 68 is not subjected to any downwardly displacing pressure. In this position the cylindrical outer recess 84 of the slide 70 forms a connection between the conduits 20 and 22, i.e. between the opposite sides of the lower piston 52, and the slide 70 closes the inlet from the medium pressure branch pipe 36.

When a medium fluid pressure is applied to the main inlet 4 this pressure will be supplied to the top chamber 54 of the cylinder 12, whereby the piston system 44,52 is forced downwardly. The connector stub 42 is closed by the descending piston 44, and the fluid in chamber 56 underneath the lower piston 52 flows to the opposite chamber 58 through the recess 84 of the control slide 70, while excess fluid will be pressed out through the conduit 26 to the tank return outlet 28.

Figure 3:
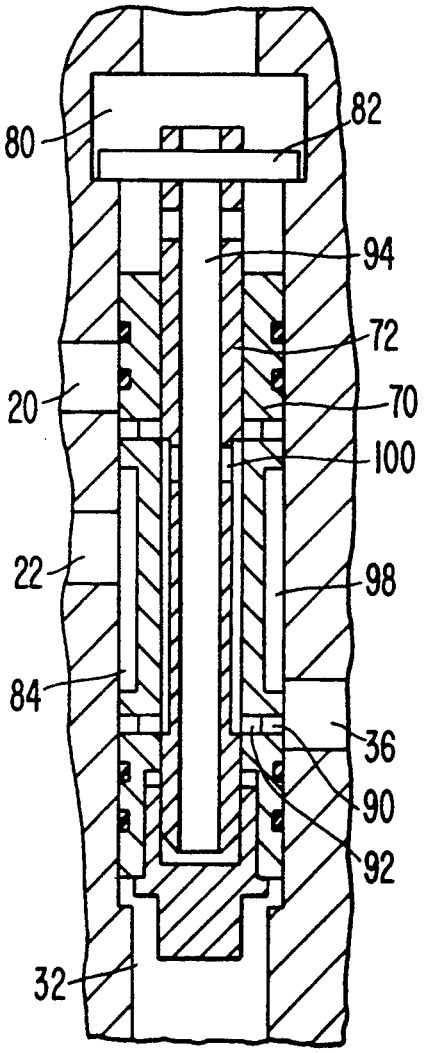

When the piston system 44,52 reaches a lower position, in which the top of the high pressure piston 44 reaches the connector stub 42 the medium pressure above the piston top will be transferred into the pilot conduit 38, whereby the medium pressure will act on the top end of the slide 68 so as to press this slide downwardly until the cross pin 82 abuts the lower end of the recess 80, see FIG. 3. In just that position the cylindrical recess 84 has left its connection with the pipe 20 and established connection between the pipe 22 and the supply pipe 36, i.e. the medium pressure fluid may now intrude into the lower cylinder chamber 56 and force the piston system upwardly in its said working stroke. The inner cylindrical recess 98 is at its lower end connected with the groove and hole system 90,92, whereby the central bore 94, through the holes 100, is connected with the supply pipe 36. Should the piston 44 already have closed the stub 42, medium pressure fluid will thus still be supplied to the slide system, biasing the same downwardly.

Figure 4:
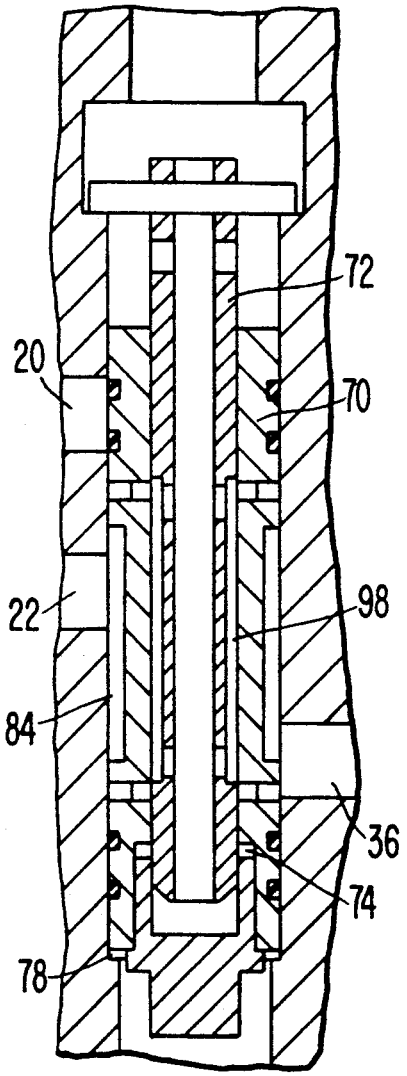

For this reason, while the auxiliary slide 72 is stopped by the pin 82 engaging the lower end of the recess 80, the slide 70 will continue downwardly, further compressing the spring 32, until it meets the lower stop shoulder 78, see FIG. 4. This extra displacement of the slide does not change the relative position of the recess 84, i.e. the working stroke of the piston system may continue or proceed, but the position of the inner recess 98 will be changed to the effect that it is closed towards the supply pipe 36 and opened towards the pipe 20, i.e. only towards the return system 22,26,28. Thus, the connection is no longer active, but it already has fulfilled one of its purposes, that is, to amplify the downward shifting movement of the slide system.

At the end of the working stroke of the piston system the lower piston end 48 will uncover the stub 42 more or less, whereby the pressure on the slide system is relieved towards the common cylinder chamber 58 and the return system 20, 26,28, i.e. now the spring 32 is able to force the slide system upwardly, see FIG. 5. Initially the inner slide 72 will be brought along by virtue of its frictional engagement with the outer slide 70 at the friction ring 74, until the cross pin 82 abuts the upper end of the recess 80. During this first phase of the shifting operation the central bore of the slide system will be briefly connected, through holes 100, recess 98, radial holes 88 and annular recess 86, with the return or low pressure pipe 20, and it will be appreciated that this gives rise to an extra and safe pressure relief of the inner pressure of the slide system, i.e. an amplification of the pressure relieving function for ensuring a safe switching of the slide system. Also, during the initial movement of the slide system, the outer cylindrical recess will be disconnected from the inlet pipe 36 and connected to the pipe 20, such that the return connection from pipe 20 to pipe 22 is rapidly reestablished as in the first instance, the medium pressure fluid will then be supplied to the upper cylinder chamber 54 through the pipe 10 for effecting a quick downstroke or return stroke of the piston system 44,52.

However, even if the stub 42 has now already been closed by the descending piston 44, the spring 32 will be able to urge the outer slide 70 further upwardly, viz. from FIG. 5 back to FIG. 2, until the upper radial holes 88 are closed for outflow of medium from the inner slide system, this position being shown in FIG. 2. It will be noted that the latter connection is closed even though the annular recess 86 is still open towards the pipe 20. At the same time the corresponding connection between the recess 98 and the lower radial holes 92 will be opened, though without any effect because the associated annular recess 90 is closed outwardly. The slide system now remains in this position while the working stroke of the piston system goes on, just as described above, whereafter the described cyclic operation will be repeated as long as the system is kept working.

The inner or auxiliary slide 72 serves the important purpose of permitting the discussed amplification functions in immediate response to each initial shifting of the slide system, so as to stabilize the shifting, and it is obtained automatically that this slide, after having performed that action at each shifting, is pre-adjusted so as to be able to perform the desired action immediately by the following shifting. It is well thinkable that the same kind of operation could be achieved by servo controlled switching means based on the use of appropriate sensors, but it will be appreciated that in the preferred embodiment of the invention it is not at all necessary to make use of such supplementary control means, which would be bound to make the system more expensive. The auxiliary slide should not necessarily operate by a relative movement in the axial direction, as it might alternatively operate by a rotational movement.

Another important advantage of the described arrangement is that it will not be required, anywhere in the system, to make use of quite narrow or nozzle-like flow connections, so also for this reason the system will be very reliable in operation. It is important that the return stroke of the piston system is effected by the medium pressure flow being supplied to the chamber 58, i.e. to the piston side having the smaller area due to the rod 50. Hereby a relatively small amount of fluid is required for displacing the piston, which promotes the desired rapidity of the return stroke.

It should be mentioned as a special advantage that the pistons 44 and 52 are always forced against each other, such that the piston rod 50 should merely act as a spacer rod, i.e. it is not required that the two pistons be rigidly interconnected. Consequently, the two cylinder portions 12 and 18 will not have to be arranged exactly coaxially with each other, which is of course also a significant advantage.

I claim:

1. A differential single-acting fluid pressure amplifier comprising:

a piston system including a first large diameter piston disposed in a large diameter cylinder portion and a second narrow diameter piston disposed in a narrow cylinder portion adjacent said large diameter cylinder portion, a medium pressure chamber defined at a free end of said first piston, a high pressure chamber defined at a free side of said second piston, a low pressure chamber defined between said first and second pistons, a medium pressure inlet connected to a medium pressure fluid source, a low pressure outlet for connecting a return conduit to said medium pressure fluid source, suction valve means for connecting said medium pressure inlet to said high pressure chamber, said low pressure outlet being connected with said low pressure chamber, an automatically controlled switching valve means for alternatingly connecting said medium pressure chamber with said medium pressure inlet and said low pressure outlet, said switching valve means including a primary switch valve member shiftable in one direction by an applied medium pressure and in an opposite direction by action of a return spring upon removal of said medium pressure, a pilot system for applying and removing said applied medium pressure, said pilot system including a pipe connected to an orifice in a wall of the narrow cylinder portion and located so as to be disposed in front of the second piston when the second piston assumes a retracted position in the narrow cylinder portion, whereby the orifice is connected with the medium pressure inlet through said suction valve means, and behind the second piston when the second piston assumes a foremost position in the narrow cylinder portion, whereby the orifice is connected with said low pressure chamber thereby enabling removal of the applied medium pressure from the switch valve member in order to enable the same to be switched by the action of the return spring to a position in which the medium pressure chamber is connected with the low pressure outlet for effecting return movement of the piston system, wherein said switch valve member, when connected with the pressure medium pressure inlet in the retracted position of the piston is caused by the applied medium pressure overcoming the action of said return spring to switch to a position in which the medium pressure chamber is connected with the medium pressure inlet for effecting a working stroke of the piston system, and wherein means are provided for ensuring that the switch valve member, by each successive shift, is fully shifted between two opposed end positions including an auxiliary switch valve member operatively connected with said primary switch valve member so as to be movable therewith, said auxiliary switch valve member having a limited displacement relative to said switch valve member in response to the primary switch valve member reaching the respective end positions such that the auxiliary valve member, at each shift, is thereafter displaced further by one of the applied medium pressure and the action of the return spring, wherein the auxiliary valve member and the pressure switch valve member are constructed such that in the initial phase of each shifting movement, the auxiliary switch valve member and the primary switch valve member establish a direct connection between the pilot system and an associated shift controlling source including one of the medium pressure source and a low pressure source, while, by the mutual displacement of the auxiliary switch valve member and the pressure switch valve member at the end of each shifting operation, a channel for establishing said direct connection is closed internally, while at the same time a corresponding channel for connection to the other pressure source is opened internally, such that it is ready for immediate action by a following shift operation of the valve members.

* * * * *